US006007386A

United States Patent [19]

Okabe

[11] Patent Number: 6,007,386

[45] Date of Patent: Dec. 28, 1999

[54] CONNECTOR

[75] Inventor: Toshiaki Okabe, Shizuoka, Japan

[73] Assignee: Yazaki Corporation, Tokyo, Japan

[21] Appl. No.: 08/922,365

[22] Filed: Sep. 3, 1997

[30] Foreign Application Priority Data

Sep. 3, 1996 [JP] Japan ..... 8-233313

[51] Int. Cl.[6] ..... H01R 13/502

[52] U.S. Cl. ..... 439/701; 439/717

[58] Field of Search ..... 439/701, 712–717, 439/660, 682, 686

[56] References Cited

U.S. PATENT DOCUMENTS 5,775,954 7/1998 Kerckhof et al. ..... 439/701

FOREIGN PATENT DOCUMENTS 4-136869 12/1992 Japan .

5-53153 7/1993 Japan .

*Primary Examiner*—Khiem Nguyen

*Attorney, Agent, or Firm*—Sughrue, Mion, Zinn Macpeak & Seas, PLLC

[57] ABSTRACT

In a multi-stage connector having a plurality of housings stacked one upon another, even if wires, disposed at a widthwise central portion of the connector, are pulled in a direction to separate the housings from each other, lock portions, connecting the housings together, will not be unlocked. Notched recesses 35 are formed respectively in rear ends of partition walls 29 separating a plurality of terminal receiving chambers 31 of upper and lower housings 17 and 19 from one another. Projections, each having a retaining pawl for engagement in the associated notched recess 35, are formed on a lower surface of each of the upper housing 17 and a cover 21.

5 Claims, 4 Drawing Sheets

CONNECTOR

BACKGROUND OF THE INVENTION

This invention relates to a connector in which a plurality of terminal receiving chambers, separated from one another by partition walls extending in a front-to-rear direction, are provided in a housing, and an opening, exposing the terminal receiving chambers, is formed in one surface of the housing, and a mounting member, comprising a cover or another housing, is attached to the housing to cover the opening.

FIG. 1 is an exploded, perspective view of a conventional connector disclosed in Japanese Utility Model Unexamined Publication No. 5-53153, and this connector is a male connector, and is a so-called multi-stage connector comprising three (upper, intermediate and lower) housings 1, 3 and 5 stacked together. Female terminals are received in each of the housings 1, 3 and 5, and insertion holes 7 are formed in a front end surface of the housing, and male terminals in a female connector (not shown) are inserted respectively into these insertion holes 7, and are contacted respectively with the female terminals. Wires 9 are press-connected respectively to the female terminals in each of the housings 1, 3 and 5, and are extended outwardly from a rear side of the connector.

The upper housing 1 and the intermediate housing 3 have the same configuration, and arm-like ribs 13 each having an inwardly-directed retaining pawl 13*a* are formed on and extend downwardly respectively from opposite side walls 11 (spaced in a direction of the width) of the housing, and engagement portions 15 for retaining engagement with the retaining pawls 13*a* are formed respectively in upper edge portions of the opposite side walls 11. The lower housing 5 is identical to the upper and intermediate housings 1 and 3 in that engagement portions 15 are formed respectively in upper edge portions of opposite side walls 11, but any arm-like rib is not provided on the lower housing.

In the connector of the above construction, the upper-side housing is placed on the upper surface of the lower-side housing, and is pushed downward, so that the retaining pawls 13*a* are retainingly engaged respectively with the engagement portions 15, and in this manner the upper, intermediate and lower housings 1, 3 and 5 are combined together to form a unitary construction.

However, in the above connector, the lock portions (each comprising the retaining pawl 13*a* and the engagement portion 15) for interconnecting the housings 1, 3 and 5 are provided on the widthwise opposite side walls 11, and therefore as shown in FIG. 2 which is a perspective view showing the connector from its rear side, when those wires 9, disposed at a central portion of the connector in the direction of the width are pulled upward and downward, the widthwise central portion is liable to be bulged particularly where the connector is of the multi-pole type having an increased width, and therefore there has been encountered a problem that the locks of the housings 1, 3 and 5 are easily disengaged and unlocked, and a sufficient reliability is not obtained.

SUMMARY OF THE INVENTION

It is therefore an object of this invention to provide a connector in which even if there is applied a force tending to separate housings from each other at a widthwise central portion of the connector, lock portions, connecting the housings together, will not be unlocked.

The above object has been achieved by a connector of the invention comprising:

a housing including, a plurality of terminal receiving chambers which are separated from one another by a plurality of partition walls extending in a front-to-rear direction, and an opening formed in one surface of the housing for exposing the terminal receiving chambers, and a covering member attached to the housing for covering the opening, wherein an engagement portion provided at rear end of each of the partition walls in the front-to-rear direction, and projections provided on the surface of the covering member facing to the opening for being engaged respectively with the engagement portions.

In the connector of this construction, when the covering member is attached to the housing to cover the opening, the projections of the covering member are engaged respectively with the engagement portions provided respectively at the ends of the partition walls close to the rear end of the connector, and therefore the housing and the covering member are connected together even at the widthwise central portion of the connector.

Preferably, the covering member comprises one of cover and another housing.

Preferably, the engagement portion is defined by a notched recess formed in the rear end of the partition wall and disposed adjacent to a bottom surface of the terminal receiving chambers, and each of the projections has a retaining pawl which projects toward a front end in the front-to-rear direction, and is fitted in the associated notched recess.

In this construction, when the covering member, comprising the cover or another housing, is attached to the housing to cover the opening, the retaining pawls of the projections are engaged respectively in the notched recesses formed respectively in the ends of the partition walls close to the rear end of the connector, and therefore the housing and the covering member are connected together even at the widthwise central portion of the connector.

Preferably, the projections comprise plate-like shaped members which are received in the opening and extend respectively from the rear ends of the partition walls toward the rear end of the connector in continuous relation to the partition walls to thereby separate the terminal receiving chambers from one another.

In this construction, the projections are received in the opening, and are engaged respectively with the engagement portions, and in this condition the projections and the partition walls jointly separate the terminal receiving chambers from one another. Thus, the projections achieve a connecting function, and also perform the function of insulating terminals from one another.

DESCRIPTION OF THE PREFERRED EMBODIMENTS

A preferred embodiment of the present invention will now be described with reference to the drawings.

Figure 1:
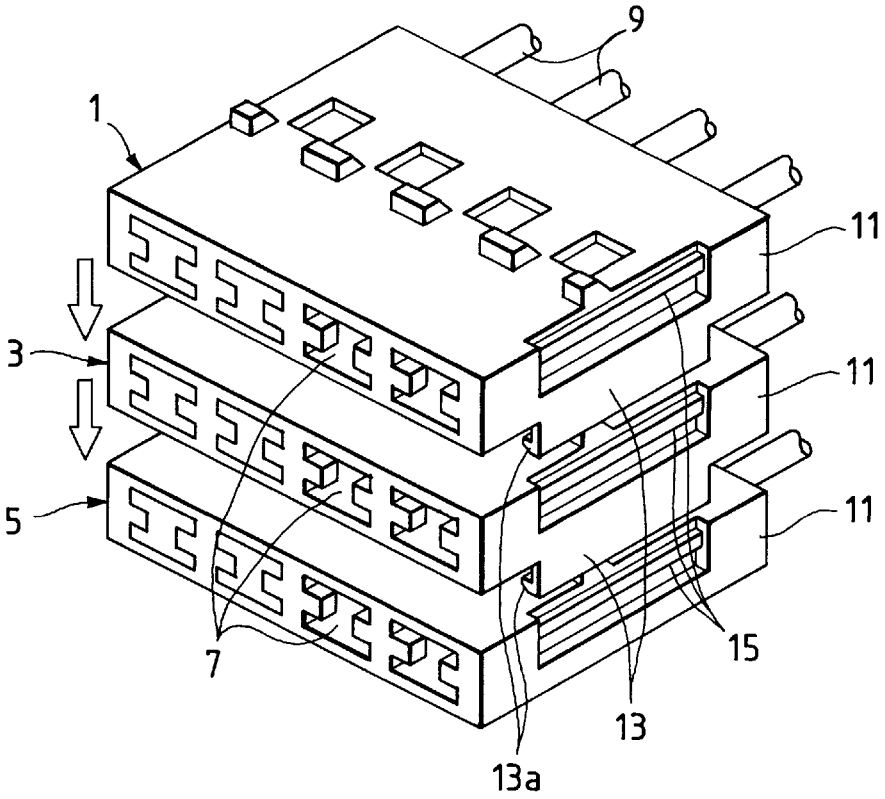
FIG. 1 PRIOR ART
FIG. 1 is an exploded, perspective view of a conventional connector.
Figure 2:
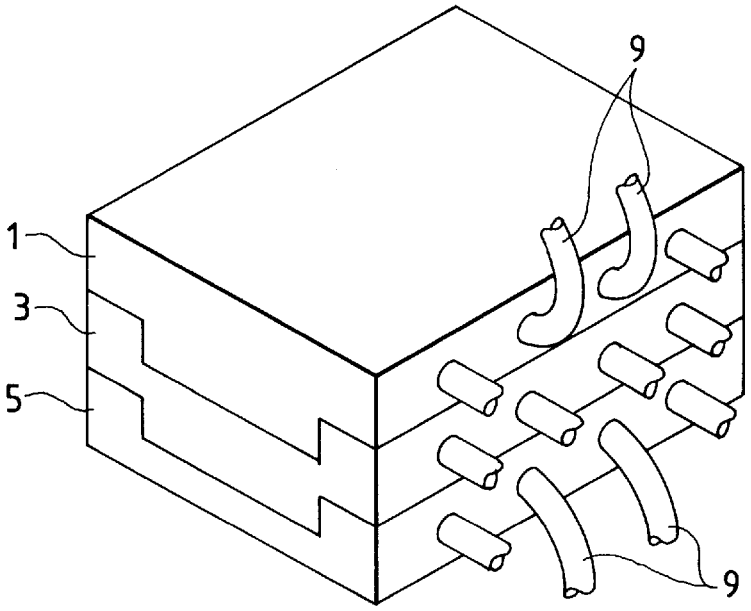
FIG. 2 PRIOR ART
FIG. 2 is a view showing a condition in which wires in the connector of FIG. 1 are pulled upwardly and downwardly.
Figure 3:
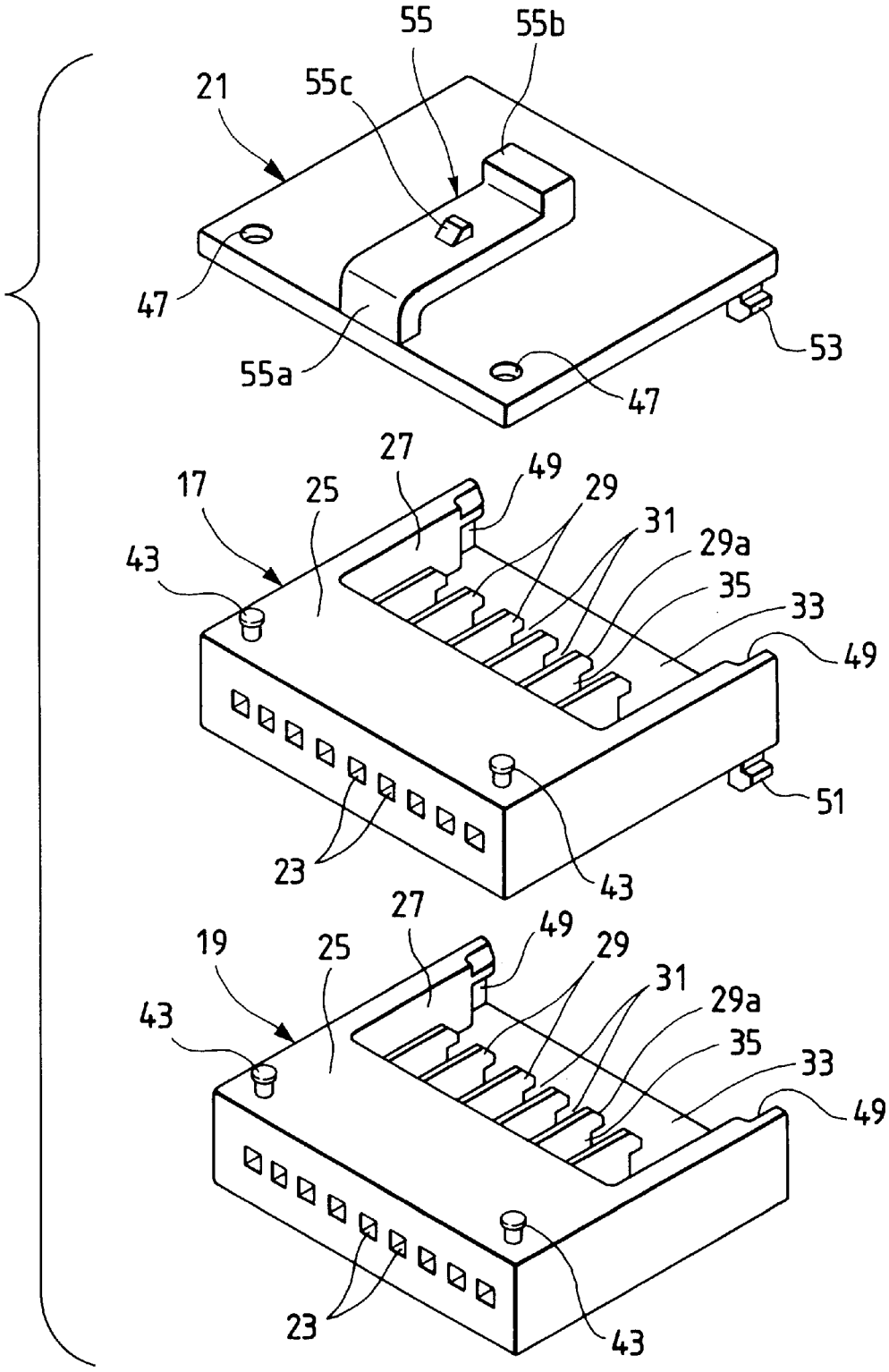
FIG. 3 is an exploded, perspective view showing one preferred embodiment of a connector of the invention.
Figure 4:
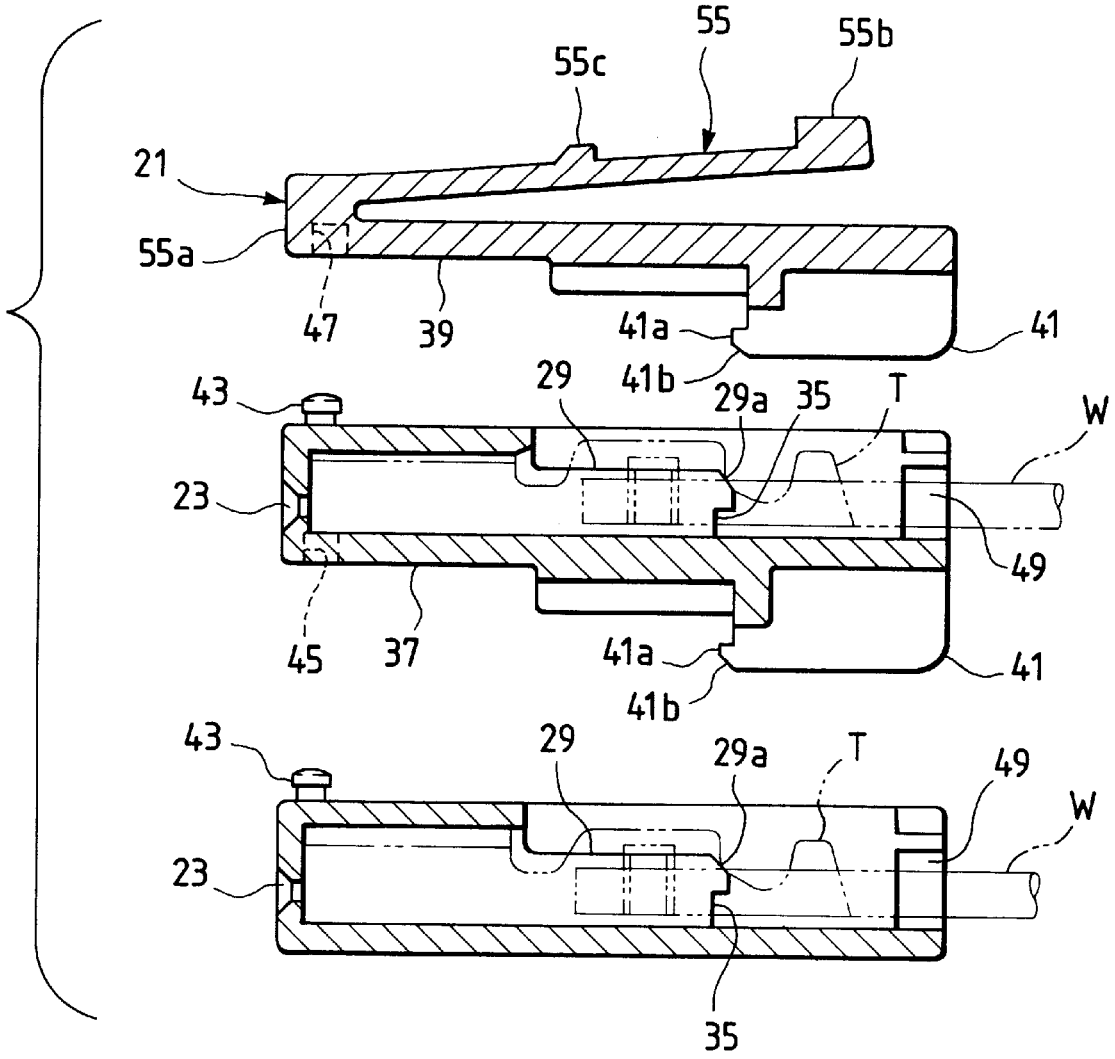
FIG. 4 is a vertical cross-sectional view of the connector 1 of FIG. 3 in its disassembled condition.

FIG. 3 is an exploded, perspective view showing one preferred embodiment of a connector of the present invention, FIG. 4 is a vertical cross-sectional view of the connector of FIG. 3, and FIG. 4 is a vertical cross-sectional view of the connector in its assembled condition. This connector is a multi-stage male connector comprising two (upper and lower) housings 17 and 19, and a cover 21. Insertion holes 23 for respectively receiving male terminals of a mating female connector are formed in a front end surface of each of the housings 17 and 19, and an opening 27 is formed in an upper surface (one surface) 25 at a rear end portion of the connector. Because of the provision of the opening 27, a plurality of terminal receiving chambers 31, separated from each other by partition walls 29, are exposed to the exterior.

The partition walls 29 have their rear end portions disposed at a generally-central portion of the opening 27 in a front-to-rear direction of the connector, and a notched recess 35 (serving as an engagement portion) is formed in that portion of each of these rear end portions disposed adjacent to a bottom surface 33 of the terminal receiving chambers 31. A slanting surface 29*a* is formed on the upper edge of the rear end portion of each partition wall 29.

As shown in FIG. 4, plate-like projections 41 are formed on a lower surface 37, 39 of each of the upper housing 17 and the cover 21, and extend rearwardly of the rear ends of the partition walls 29 toward the rear end of the connector in registry respectively with extension lines of the partition walls 29. A retaining pawl 41*a* for engagement in the notched recess 35 in the associated partition wall 29 is formed on one end of the projection 41 directed toward the front end of the connector, and projects toward the front end (in a left-hand direction in FIG. 4) of the connector. A slanting surface 41*b* is formed on a lower edge of the retaining pawl 41*a*.

The projections 41 are received in that portion of the opening 27 extending rearwardly from the rear ends of the partition walls 29, and are continuous respectively with the partition walls 29, in a state that the retaining pawls 41*a* are engaged respectively in the notched recesses 35, so that the projections 41 cooperate with the partition walls 29 to isolate crimping terminals T, received in the housing, from one another, thereby achieving an insulating effect. Sheathed wires W are press-connected respectively to the crimping terminals T, and a crimping blade of each crimping terminal T cuts a sheath of the sheathed wire W, and contacts a conductor therein, thereby making an electrical connection between the crimping terminal T and the sheathed wire W.

Engagement projections 43 are formed respectively on opposite side portions of the upper surface 25 of each of the upper and lower housings 17 and 19 at the front end portion of the connector, and engagement holes 45 (see FIG. 4) for fitting respectively on the engagement projections 43 on the lower housing 19 are formed respectively in those portions of the lower surface 37 of the upper housing 17 corresponding respectively to the engagement projections 43. Engagement holes 47 for fitting respectively on the engagement projections 43 on the upper housing 17 are formed respectively in opposite side portions of the cover 21.

Engagement recesses 49 are formed respectively in upper portions of rear ends of opposite side walls of each of the upper and lower housings 17 and 19, and engagement pawls 51 for being engaged respectively in the engagement recesses 49 in the lower housing 19 are formed respectively on those portions of the lower surface 37 of the upper housing 17 corresponding respectively to the engagement recesses 49. Engagement pawls 53 for being engaged respectively in the engagement recesses 49 in the upper housing 17 are formed respectively on the opposite side portions of the lower surface 39 of the cover 21 at the rear end portion of the connector.

A lock piece 55 for locking the mating female connector is formed on a widthwise central portion of the cover 21. The lock piece 55 is connected to a body of the cover 21 by a connecting portion 55*a*, and is disposed between the engagement recesses 49, and an operating push portion 55*b* at a distal end thereof is elastically movable upward and downward about the connecting portion 55*a*, and a lock pawl 55*c*, formed on a central portion of the lock piece 55 is engageable with the mating female connector.

In the above connector, when the upper housing 17 is mounted as a mounting member on the lower housing 19 to cover the opening 27 thereof, the engagement projections 43 are engaged respectively in the engagement holes 45, and also the engagement pawls 51 are engaged respectively in the engagement recesses 49. At this time, as shown in FIGS. 4 and 5, the projections 41 of the upper housing 17 are received in the opening 27 in the lower housing 19, and the slanting surfaces 41*b* of the retaining pawls 41*a* slide respectively over the slanting surfaces 29*a* of the partition walls 29 of the lower housing 19, and the engagement pawls 41*a* are fitted respectively into the notched recesses 35 formed respectively in the partition walls 29, so that the upper and lower housings 17 and 19 are fixedly connected together.

Figure 5:
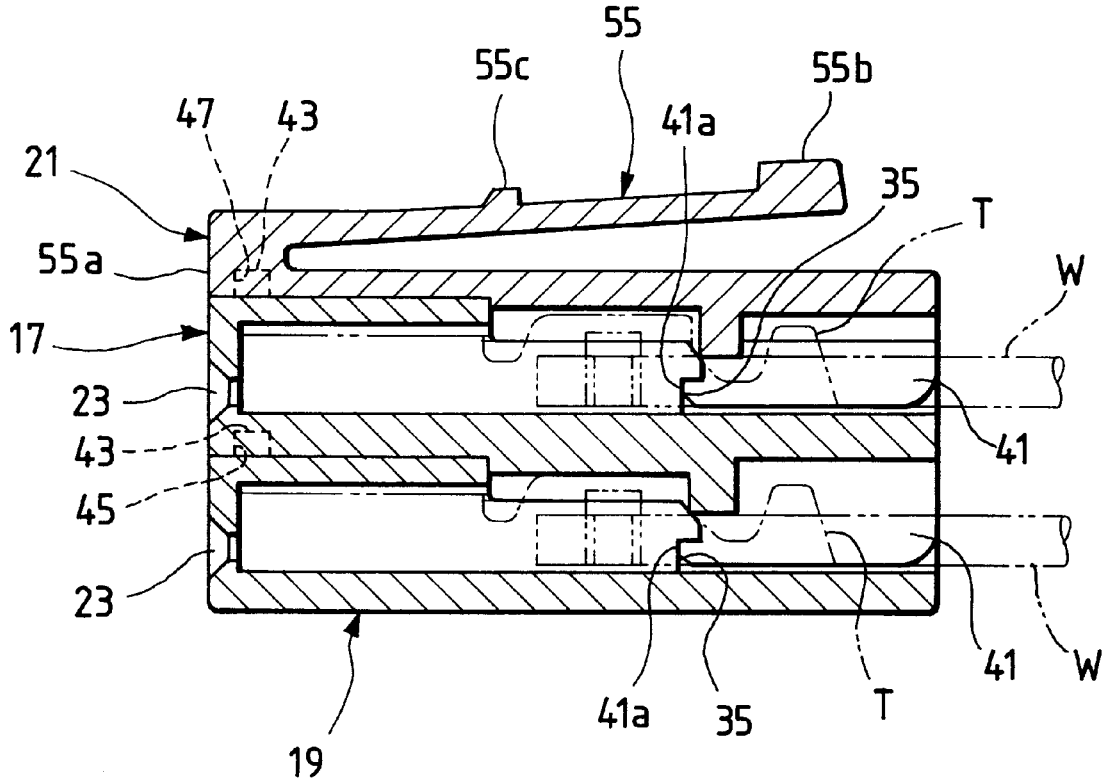
FIG. 5 is a vertical cross-sectional view of the connector of FIG. 3 in its assembled condition.

For attaching the cover 21 (serving as a mounting member) to the upper housing 17 mounted on the lower housing 19, the cover 21 is attached to the upper housing 17 to cover the opening 27 thereof as described above, and as a result the engagement projections 43 are engaged respectively in the engagement holes 47, and also the engagement pawls 53 are engaged respectively in the engagement recesses 49 as shown in FIGS. 3–5. At this time, the projections 41 of the cover 21 are received in the opening 27 in the upper housing 17, and the slanting surfaces 41*b* of the retaining pawls 41*a* slide respectively over the slanting surfaces 29*a* of the partition walls 29 of the upper housing 17, and the engagement pawls 41*a* are fitted respectively into the notched recesses 35 formed respectively in the partition walls 29, so that the cover and the upper housing are fixedly connected together.

In the above-mentioned connector, the upper and lower housings 17 and 19 are locked together even at the widthwise central portion of the connector in such a manner the retaining pawls 41*a* of the projections 41 are retainingly engaged respectively in the notched recesses 35 formed respectively in the rear ends of the partition walls 29 separating the terminal receiving chambers 31 from one another, and similarly the upper housing 17 and the cover 21 are locked together. Therefore, even if there is applied a force tending to separate the upper and lower housings 17 and 19 from each other at the widthwise central portion of the connector (for example, when the sheathed wires W in the upper housing 17 are pulled upwardly, or the sheathed wire W in the lower housing 19 are pulled downwardly), or if there is applied a force tending to separate the upper housing 17 and the cover 21 from each other at the widthwise central portion of the connector, the bulging at the widthwise central portion, which would rather easily occur particularly with respect to a connector of the multi-pole type having an increased width, can be prevented. As a result, the retaining pawls 51 and 53 are prevented from being disengaged from the respective retaining recesses 49, and also the retaining projections 43 are prevented from being disengaged from the respective retaining holes 45 and 47, and the reliability of the connector is enhanced.

As described above, in the present invention, when the mounting member, comprising the cover or another housing, is attached to the housing to cover the opening, the projections of the mounting member are engaged respectively with the engagement portions provided respectively at the ends of the partition walls close to the rear end of the connector, and therefore the housing and the mounting member are connected together even at the widthwise central portion of the connector. Therefore, even if there is applied a force tending to separate the two from each other at the widthwise central portion of the connector, the two are prevented from moving away from each other, and are prevented from being disengaged from each other.

The projections have a plate-like shape, and are received in the opening, and extend respectively from the rear ends of the partition walls toward the rear end of the connector in continuous relation to the partition walls to thereby separate the terminal receiving chambers from one another. With this construction, the projections achieve the connecting function, and also perform the function of insulating the terminals from one another.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A connector, comprising:

a housing including, a plurality of terminal receiving chambers which are separated from one another by a plurality of partition walls extending in a front-to-rear direction, and an opening formed in one surface of said housing for exposing said terminal receiving chambers, and a covering member attached to said housing for covering said opening, wherein an engagement portion is provided at a rear end of each of said partition walls in said front-to-rear direction, and projections are provided on the surface of the covering member facing said opening for engaging respectively with said engagement portions, and wherein the engaging of said engagement portion and said projections maintains the attachment of said covering member to said housing when a wire disposed in said terminal receiving chambers exerts a force against said covering member.

2. A connector according to claim 1, in which said covering member is one a of cover and another housing.

3. A connector according to claim 1, in which said engagement portion is defined by a notched recess formed in the rear end of said partition wall and disposed adjacent to a bottom surface of each of said terminal receiving chambers, and each of said projections has a retaining pawl which projects toward a front end in said front-to-rear direction, and is fitted in said notched recess.

4. A connector, comprising:

a housing including, a plurality of terminal receiving chambers which are separated from one another by a plurality of partition walls extending in a front-to-rear direction, and an opening formed in one surface of said housing for exposing said terminal receiving chambers, and a covering member attached to said housing for covering said opening, wherein an engagement portion is provided at a rear end of each of said partition walls in said front-to-rear direction, and projections are provided on the surface of the covering member facing said opening for being engaged respectively with said engagement portions, wherein said projections comprise plate-like shaped members which are received in said opening and extend respectively from the rear ends of said partition walls toward the rear end of the connector in continuous relation to said partition walls to thereby separate said terminal receiving chambers from one another.

5. A connector, comprising:

a housing including, a plurality of tenninal receiving chambers which are separated from one another by a plurality of partition walls extending in a front-to-rear direction, and an opening formed in one surface of said housing for exposing said terminal receiving chambers, and a covering member attached to said housing for covering said opening, wherein an engagement portion provided at a rear end of each of said partition walls in said front-to-rear direction, and projections provided on the surface of the covering member facing to said opening for being engaged respectively with said engagement portions, wherein said covering member is one of a cover and another housing, wherein said projections comprise plate-like shaped members which are received in said opening and extend respectively from the rear ends of said partition walls toward the rear end of the connector in continuous relation to said partition walls to thereby separate said terminal receiving chambers from one another.

* * * * *